US008091391B2

(12) United States Patent
Yu et al.

(10) Patent No.: US 8,091,391 B2
(45) Date of Patent: Jan. 10, 2012

(54) PADLOCK

(75) Inventors: Chun Te Yu, Fusing Township (TW); Cory O. Nykoluk, St. Louis, MO (US)

(73) Assignees: Chun Te Yu, Fu Shing Changhwa (TW); Fullyear-Brother Enterprise Co., Fu Shing Changhwa (TW)

( * ) Notice: Subject to any disclaimer, the term of this patent is extended or adjusted under 35 U.S.C. 154(b) by 0 days.

(21) Appl. No.: 10/671,659

(22) Filed: Sep. 29, 2003

(65) Prior Publication Data

US 2005/0039500 A1 Feb. 24, 2005
US 2007/0271969 A9 Nov. 29, 2007

Related U.S. Application Data

(60) Provisional application No. 60/443,331, filed on Jan. 29, 2003.

(30) Foreign Application Priority Data

Aug. 22, 2003 (TW) ..... 92215338 U

(51) Int. Cl.
*E05B 37/02* (2006.01)

(52) U.S. Cl. ..... 70/21; 70/25; 70/38 A; 70/38 B; 70/284; 70/285; 70/379 R

(58) Field of Classification Search ..... 70/21, 24–26, 70/284, 285, DIG. 63, DIG. 71, 30, 49, 38 R, 70/38 A, 38 B, 38 C, 29, 379 R, 379 A, 380, 70/22, 54–56, 52, DIG. 43, DIG. 56; D8/330–336, D8/338, 339, 341
See application file for complete search history.

(56) References Cited

U.S. PATENT DOCUMENTS 686,882 A * 11/1901 Ballou ..... 70/38 C
839,333 A * 12/1906 Stolt ..... 70/26
856,700 A * 6/1907 Hoag ..... 70/25
859,614 A * 7/1907 Paddock ..... 70/25
888,910 A * 5/1908 Kreuzberger ..... 70/26

(Continued)

FOREIGN PATENT DOCUMENTS

CN 2041340 U * 7/1989

OTHER PUBLICATIONS

Columbia Sportswear Company—Adventure Gear Fall 2003/Spring 2004 Catalogue, pp. 1-4, Nov. 2002.*

*Primary Examiner* — Lloyd Gall
(74) *Attorney, Agent, or Firm* — Bacon & Thomas, PLLC

(57) ABSTRACT

A padlock that can be unlocked by the owner of the padlock by dialing an unlocking number or by authorized security personals with a general key. The padlock mainly contains a lock body, a block, a shackle, a general locking device and a private locking device. The lock body has a first channel and a second channel therein. The block is engaged with the second channel. The block has a receptacle therein. The shackle has a longer arm slidably received in the first channel and a shorter arm engageable with the receptacle of the block. The general locking device is formed in the lock body for locking or unlocking the longer arm of the shackle. The private locking device is formed in the lock body for controlling movements of the block in order the block to be engaged with or disengaged from the shorter arm of the shackle.

4 Claims, 16 Drawing Sheets

U.S. PATENT DOCUMENTS 980,798 A * 1/1911 Krajdocha ..... 70/26
1,408,771 A * 3/1922 Nielsen ..... 70/25
1,426,978 A * 8/1922 Gambino ..... 70/25
1,445,719 A * 2/1923 Rozycki ..... 70/26
1,462,869 A * 7/1923 Primak ..... 70/38 B
1,550,379 A * 8/1925 Manteufel ..... 70/492
1,564,463 A * 12/1925 Best ..... 70/380
1,622,999 A * 3/1927 Frith ..... 70/38 A
1,737,477 A * 11/1929 Schmidt ..... 70/25
2,497,619 A * 2/1950 Mass ..... 70/25
2,759,350 A * 8/1956 Swanson ..... 70/38 B
3,345,837 A * 10/1967 Barnes ..... 70/52
3,349,584 A * 10/1967 Russell et al. ..... 70/21
3,472,049 A * 10/1969 Sewell ..... 70/21
3,533,253 A * 10/1970 Paul et al. ..... 70/25
3,546,906 A * 12/1970 Yang ..... 70/21
3,559,429 A * 2/1971 Hermann ..... 70/85
3,729,962 A * 5/1973 Harrington et al. ..... 70/25
3,823,584 A * 7/1974 Gill ..... 70/21
3,894,415 A * 7/1975 Bako ..... 70/21
3,952,559 A * 4/1976 Atkinson ..... 70/25
RE30,243 E * 4/1980 Oliver ..... 70/38 A
4,462,231 A * 7/1984 Zabel ..... 70/21
4,829,795 A * 5/1989 Taylor ..... 70/54
4,876,866 A * 10/1989 Fleming et al. ..... 70/379 R
5,263,348 A * 11/1993 Wittwer ..... 70/379 R
5,363,678 A * 11/1994 Meckbach ..... 70/38 A
6,035,672 A * 3/2000 Lai ..... 70/25
6,085,558 A * 7/2000 Strathmann ..... 70/153
D431,769 S * 10/2000 Gast ..... D8/346
D450,560 S * 11/2001 Yu ..... D8/333
6,467,316 B1 * 10/2002 Chen ..... 70/56
D470,743 S * 2/2003 Koy ..... D8/334
6,530,248 B1 * 3/2003 Parker ..... 70/14
6,644,076 B2 * 11/2003 Huang ..... 70/379 R
6,708,534 B1 * 3/2004 Ruan ..... 70/38 A
6,877,345 B1 * 4/2005 Misner et al. ..... 70/25
7,174,756 B2 * 2/2007 Ling et al. ..... 70/284
7,340,927 B2 * 3/2008 Yu et al. ..... 70/21
7,424,812 B2 * 9/2008 Loughlin et al. ..... 70/56
7,434,426 B2 * 10/2008 Loughlin et al. ..... 70/25
7,493,785 B2 * 2/2009 Yu et al. ..... 70/21
2002/0088256 A1 * 7/2002 Taylor et al. ..... 70/25
2003/0000264 A1 * 1/2003 Yang ..... 70/25
2004/0226324 A1 * 11/2004 Loughlin et al. ..... 70/25
2005/0039501 A1 * 2/2005 Yu ..... 70/29
2005/0044901 A1 * 3/2005 Yu ..... 70/25
2005/0132762 A1 * 6/2005 Yu ..... 70/25

* cited by examiner

PADLOCK

TECHNICAL FIELD

This invention relates generally to a padlock, in particular, to provide a padlock having a shackle locked by a key operated locking means at one end and a combination locking means at another end, thereby the padlock can be unlocked by using a key or by dialing the combination locking means to an unlocking number.

BACKGROUND OF THE INVENTION

Preventing personal stuffs from being lost or stolen, travelers usually lock their own travel baggage boxes. Combination lock is the most common lock that installed in a travel baggage box because it takes little space. Each traveler sets up his own security number for the combination lock. Thereby others without knowing the security number cannot unlock his baggage box. However terrorists may use travel baggage boxes to deliver explosive devices to endanger people's safety. Security personals in airports may need to exam travels' travel baggage boxes in some circumstances without presence of the owners of the travel baggage boxes. Some countries require travelers not to lock their travel baggage boxes. The travelers may lose their properties in their travel baggage boxes if they leave their travel baggage boxes unlocked. If they choose to lock their baggage boxes, the security personals are authorized to damage the travel baggage boxes in order to exam objects inside of the travel baggage boxes. There is a dilemma between travelers' rights and flight safety. Therefore, a padlock that can protect travels' properties and allow security personals to unlock the padlock is needed as well.

SUMMARY OF INVENTION

It is therefore an objective of the present invention to provide a padlock that can be unlocked by the owner of the padlock by dialing an unlocking number or by authorized security personals with a general key.

The present invention, briefly summarized, in one embodiment discloses a padlock. The padlock mainly contains a lock body, a block, a shackle, a general locking means and a private locking means. The lock body has a first channel and a second channel therein. The block is engaged with the second channel. The block has a receptacle therein. The shackle has a longer arm slidably received in the first channel and a shorter arm engagable with the receptacle of the block. The general locking means is formed in the lock body for locking or unlocking the longer arm of the shackle. The private locking means is formed in the lock body for controlling movements of the block in order the block to be engaged with or disengaged from the shorter arm of the shackle.

BRIEF DESCRIPTION OF DRAWINGS

The invention will be more clearly understood after referring to the following detailed description read in conjunction with the drawings wherein.

DETAILED DESCRIPTION OF PREFERRED EMBODIMENTS

Figure 2:
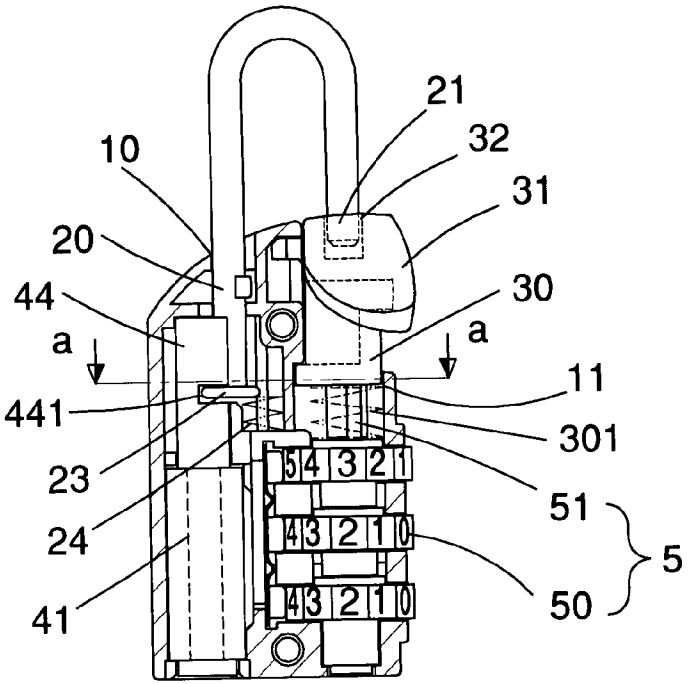
FIG. 2 is a cross sectional view of the locked first embodiment.
Figure 1:
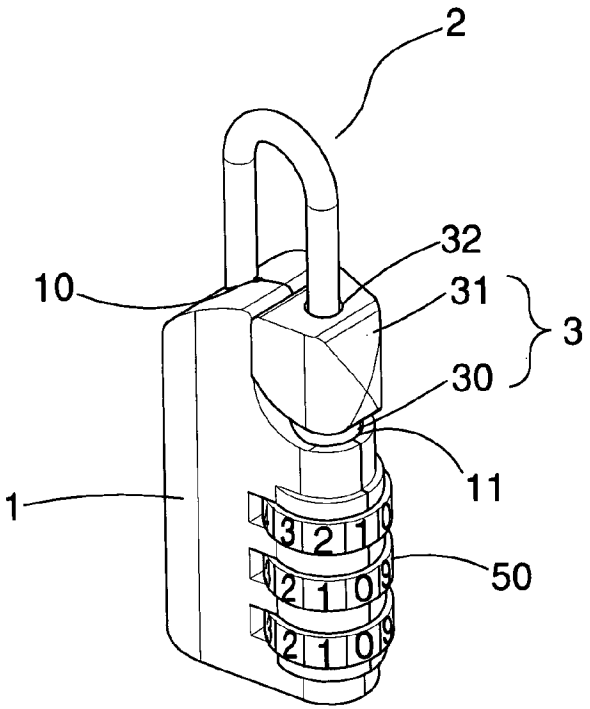
FIG. 1 is a perspective view of the first embodiment of present invention.
Figure 4:
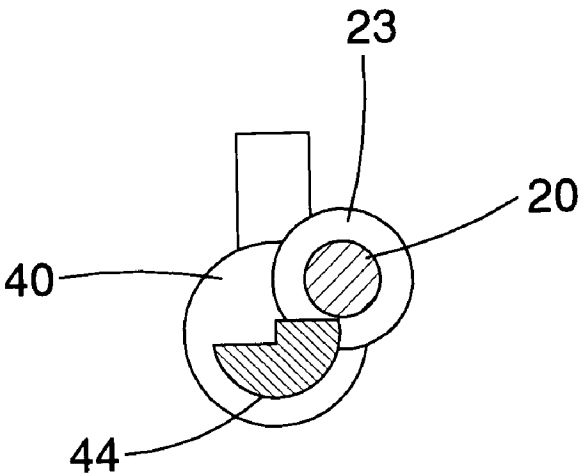
FIG. 4 is a cross sectional view of the first embodiment demonstrating the key operated locking means engaged with the flange of the longer arm of the shackle.
Figure 3:
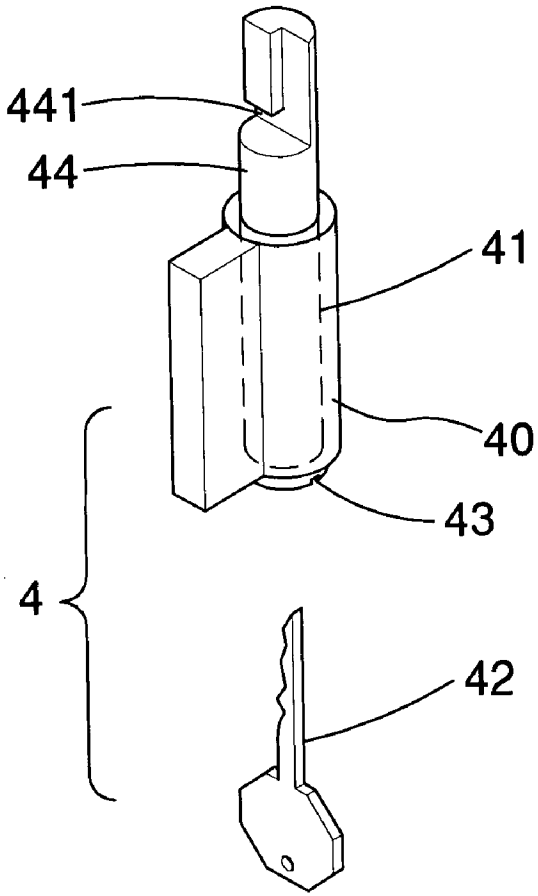
FIG. 3 is a perspective view of the key operated locking means of the first embodiment.
Figure 7:
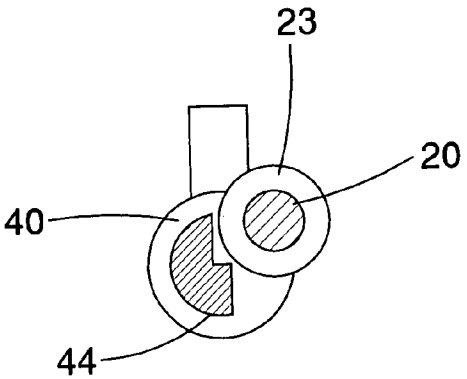
FIG. 7 is a cross sectional view of the first embodiment demonstrating the flange of the longer arm of the shackle being released from the key operated locking means.

With reference to FIG. 1 and FIG. 2, the padlock of the first embodiment contains a lock body 1, a block 3, a shackle 2, a key operated locking means 4 and a combination locking means 5. The lock body 1 has a first channel 10 and a second channel 11 therein. The block 3 contains an engaging portion 31 having a receptacle 32 therein and a mounting portion 30 under the engaging portion 31. The mounting portion 30 is received in the second channel 11 of the lock body 1. The combination locking means 5 is formed in the lock body 1 for controlling movements of the block 3 in order the block 3 to be engaged with or disengaged from the shorter arm 21 of the shackle 2. The combination locking means 5 contains a stem 51 connected to the mounting portion 30 and plural number wheels 50 rotatably mounted around the stem 51 for controlling vertical movement of the block 3. Only when the number wheel is dialed to the unlocking number the stem 51 can move vertically. The engaging portion 31 is located outside of the second channel 11 of the lock body 1. The shackle 2 has a longer arm 20 slidably received in the first channel 10 and a shorter arm 21 engagable with the receptacle 32 of the block 3. The longer arm 20 of the shackle 2 having a flange 23 near an end thereof. The key operated locking means 4 is formed in the lock body 1 for locking or unlocking the longer arm 20 of the shackle 2. Referring to FIG. 3, FIG. 4 and FIG. 7, the key operated locking means 4 contains: a body 40 having a rotor 41 received therein and a driving rod 44 extended from the rotor 41. The rotor 41 has a keyhole 43 at a bottom end thereof for being engaged with a key 42. The driving rod 44 has the notch 441 therein engagable with the flange 23 of the longer arm 20 of the shackle 2. The key 42 can rotate the rotor 41 and the driving rod 44 to disengage the notch 441 from the flange 23.

Figure 5:
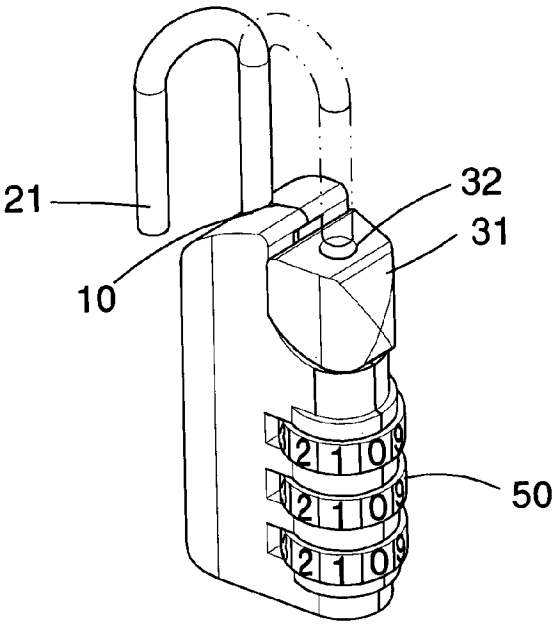
FIG. 5 is a perspective view of the first embodiment showing the block being moved downwardly and the shorter arm of the shackle being removed from the receptacle of the block.

With reference to FIG. 2 and FIG. 5, when the number wheels 50 are dialed to an unlocking number, the stem 51 can move vertically. Since the stem 51 is connected to the mounting portion 30 of the block 3 and the mounting portion 30 connected under the engaging portion 31, the engaging portion 31 of the block 3 can be moved downwardly and the shorter arm 21 of the shackle 2 can be removed from the receptacle 32 of the block 3.

Figure 6:
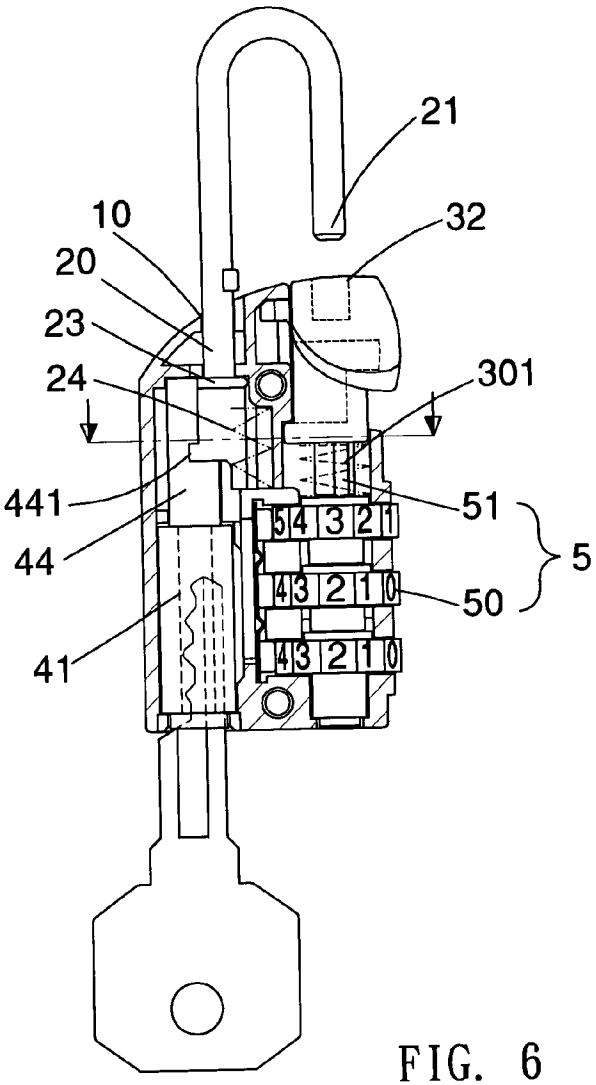
FIG. 6 is a cross sectional view of the first embodiment showing the longer arm of the shackle being released from the key operated locking means.

Referring to FIG. 2 and FIG. 6, a first spring 24 is engaged with the flange 23 of the longer arm 20 of the shackle 2 for biasing the shackle 2. Therefore when the notch 441 is not engaged with the flange 23, the spring 24 can automatically eject the longer arm 20 of the shackle 2 out. Because the shorter arm 21 and the longer arm 20 are rigidly connected, when the longer arm 20 is ejected upwardly, the shorter arm 21 is also biased out of the receptacle 32 of the block 3. With reference to FIG. 2 and FIG. 5, the second spring 301 is located between the combination locking means 5 and the block 3. The second spring 301 can restore the block 3 to original position and thereby the receptacle 32 can be engaged with the shorter arm 21 of the shackle 2.

In view of the above descriptions, the shorter arm 21 of the shackle 2 can be removed from the receptacle 32 of the block 3 to an unlocked position by using the key 42 to unlock the key operated locking means 4 or dialing the number wheels 50 to an unlocking number. Padlock manufactures can be requested by the government having security concern to make many padlocks with same key operated locking means 4 and the users can decide their own unlocking number. Thereby, only the owner of the padlock or the authorized security personal with the particular key 42 can open the padlock. Accordingly travelers can prevent properties locked by the padlock from being lost and the security personals can open the padlock when necessary and others cannot open the padlock.

Figure 8:
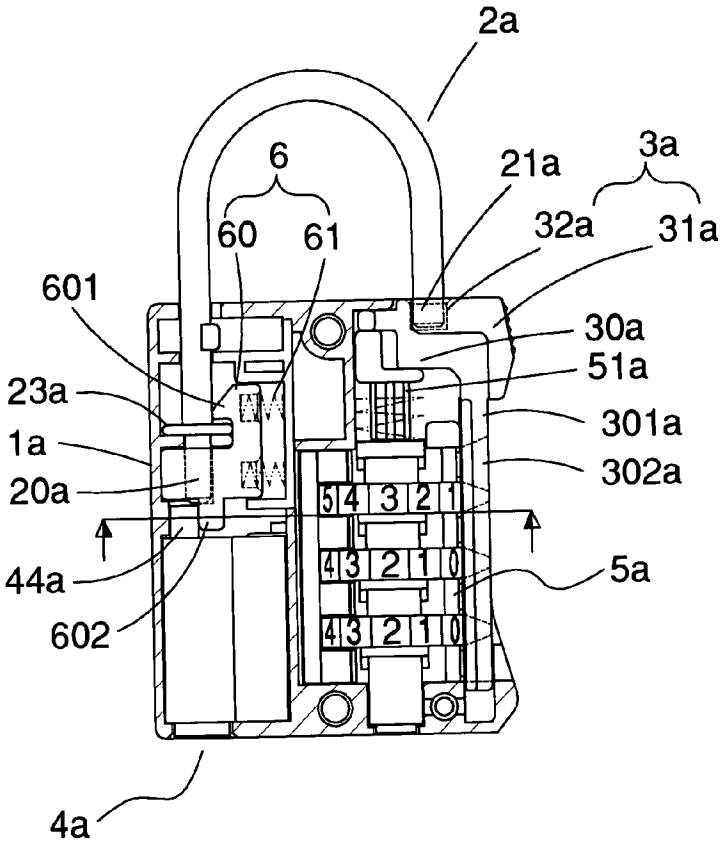
FIG. 8 is a cross sectional view of the second embodiment showing the shackle being in a locked position.
Figure 10:
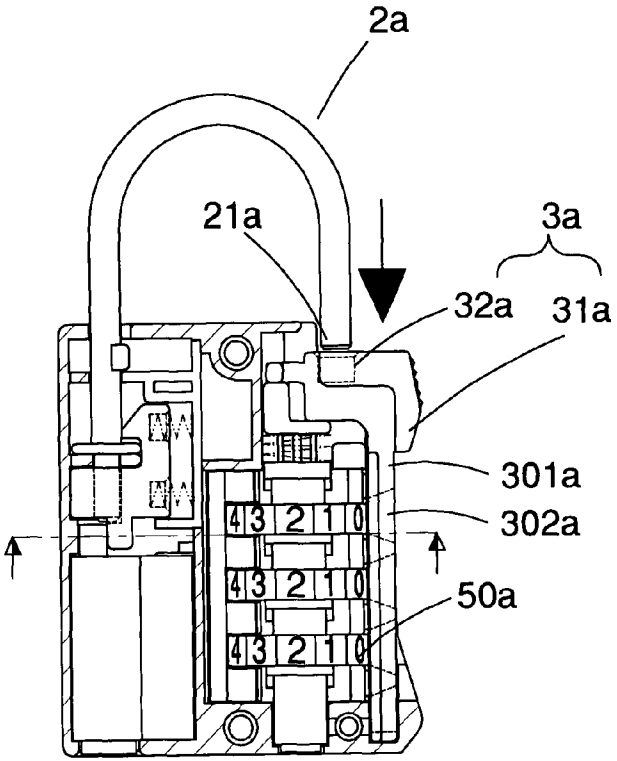
FIG. 10 is a cross sectional view of the second embodiment showing the block being moved downwardly and the shorter arm of the shackle being disengaged from the receptacle of the block.
Figure 9:
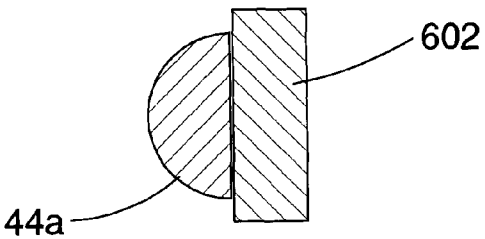
FIG. 9 is a cross sectional view of the semi-cylinder engaged with the rectangular bump of the locking block of the second embodiment.
Figure 12:
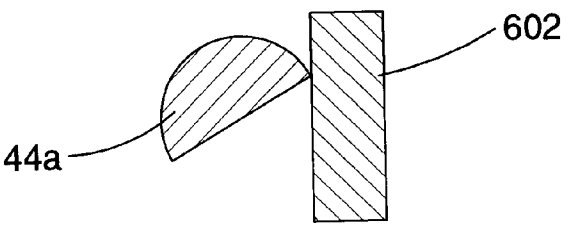
FIG. 12 is a cross sectional view of the semi-cylinder rotated and press against the rectangular bump of the locking block of the second embodiment.
Figure 11:
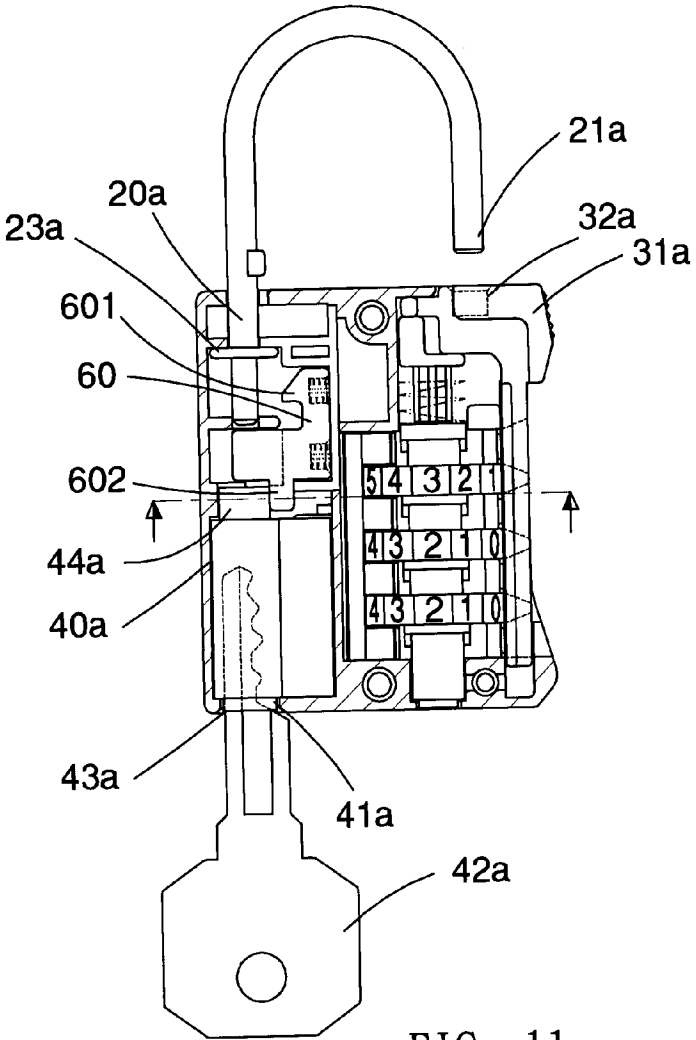
FIG. 11 is a cross sectional view of the second embodiment showing the longer arm of the shackle being released from the hook of the locking block.
Figure 14:
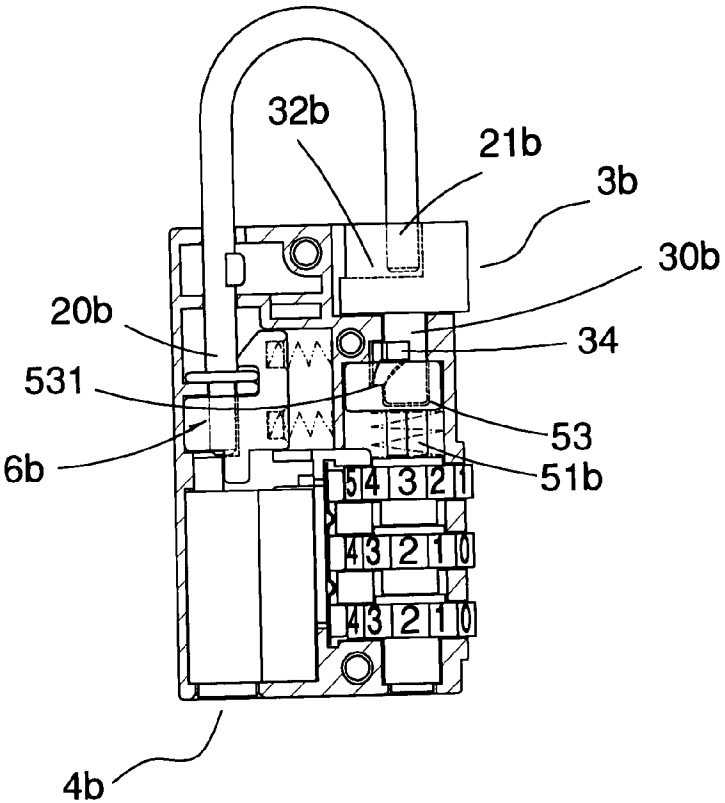
FIG. 14 is a cross sectional view of the third embodiment showing the shackle being locked.
Figure 13:
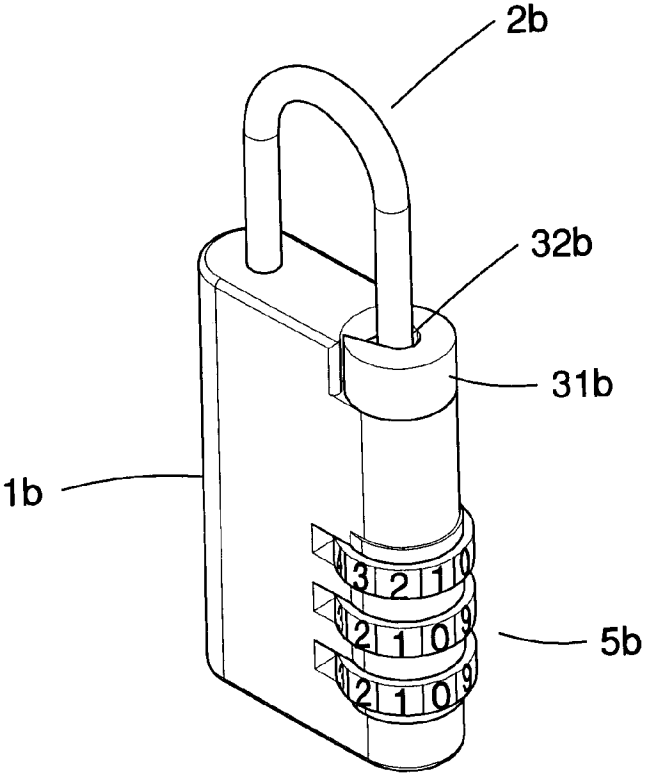
FIG. 13 is a perspective view of the third embodiment.
Figure 16:
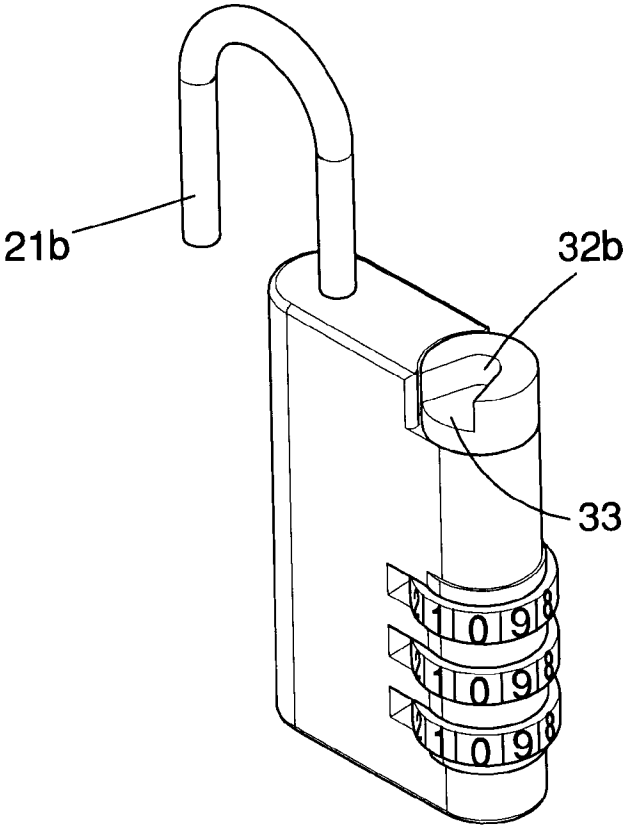
FIG. 16 is a perspective view of the third embodiment showing the gap of the receptacle of the block being rotated to a position for releasing the shorter arm of the shackle.
Figure 15:
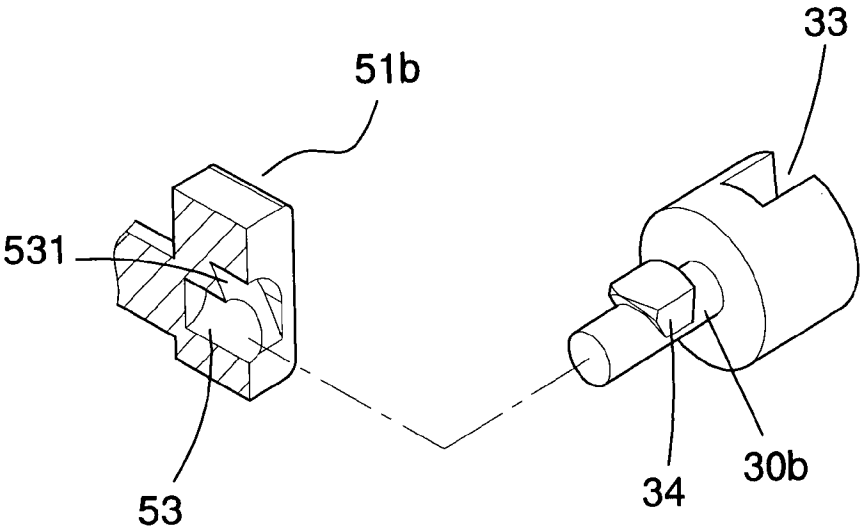
FIG. 15 is a exploded view of the block of the third embodiment.
Figure 18:
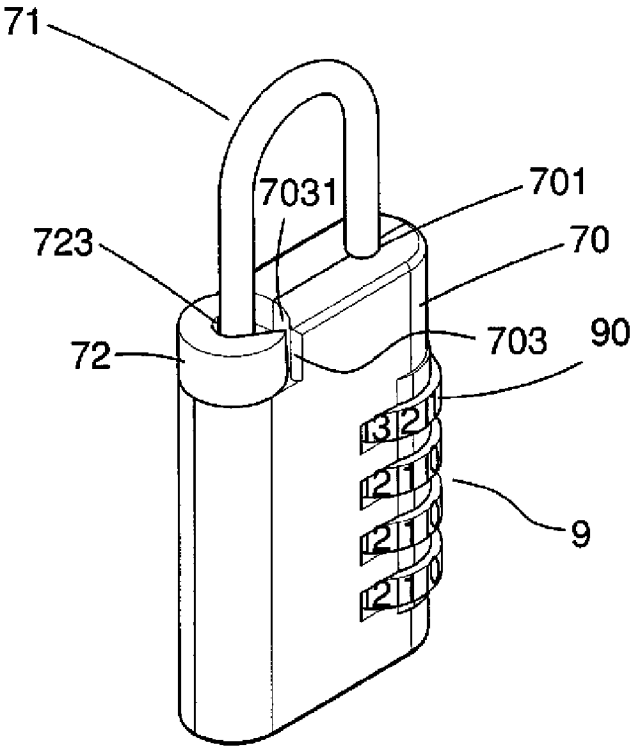
FIG. 18 is a perspective view of the fourth embodiment.
Figure 17:
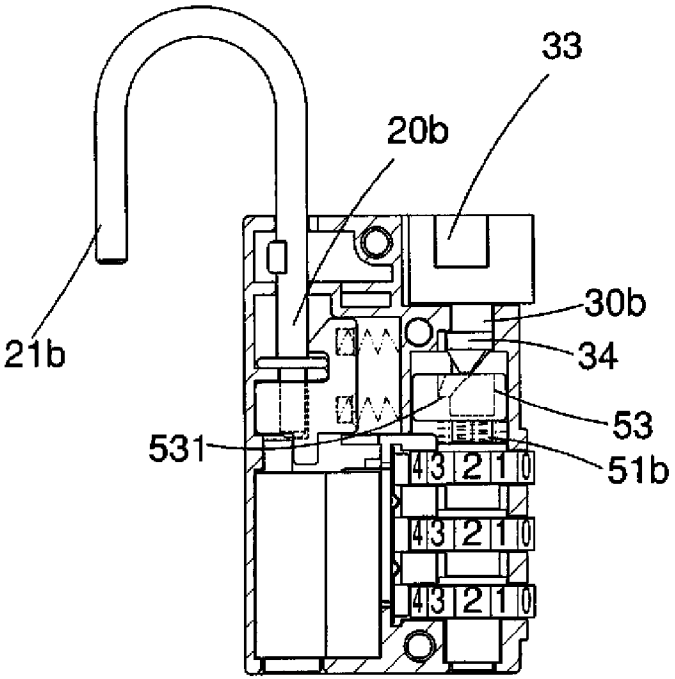
FIG. 17 is a cross sectional view of the third embodiment showing the shorter arm of the shackle be released from the gap of the receptacle of the block.
Figure 20:
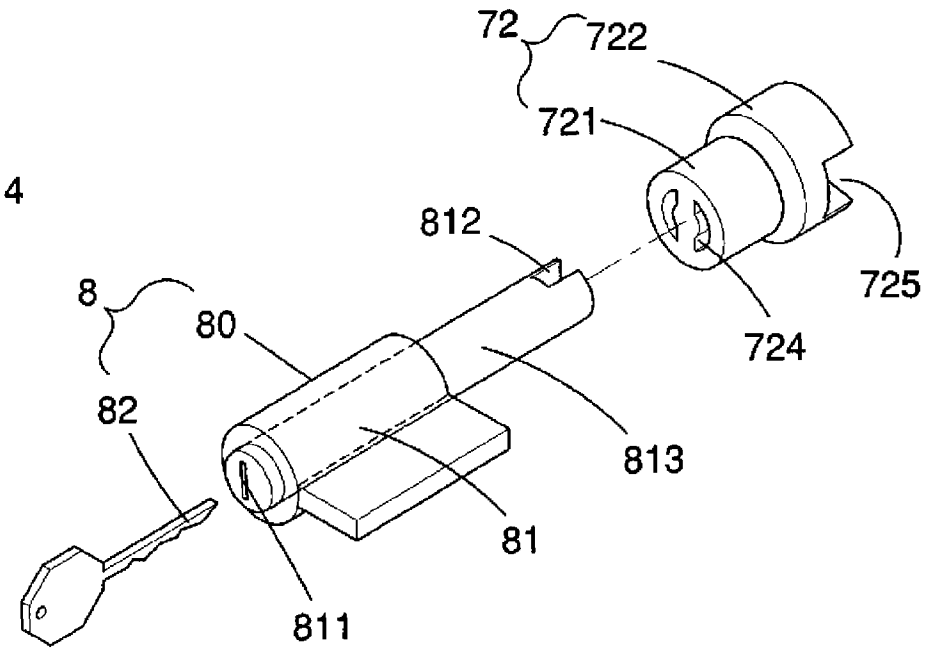
FIG. 20 is an exploded view of the key operated locking means and the block of the fourth embodiment.
Figure 19:
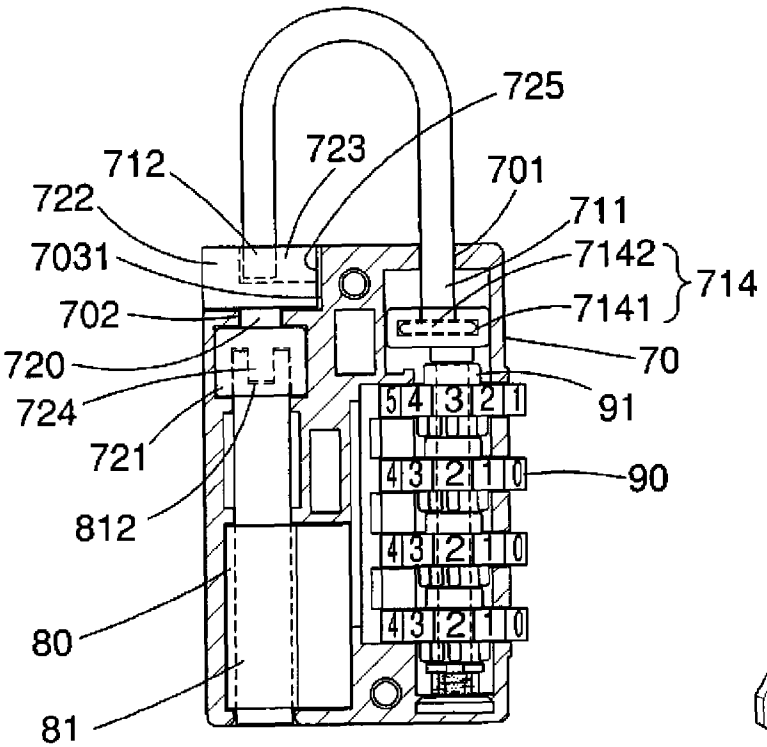
FIG. 19 is a cross sectional view of the fourth embodiment showing the shackle being locked.
Figure 22:
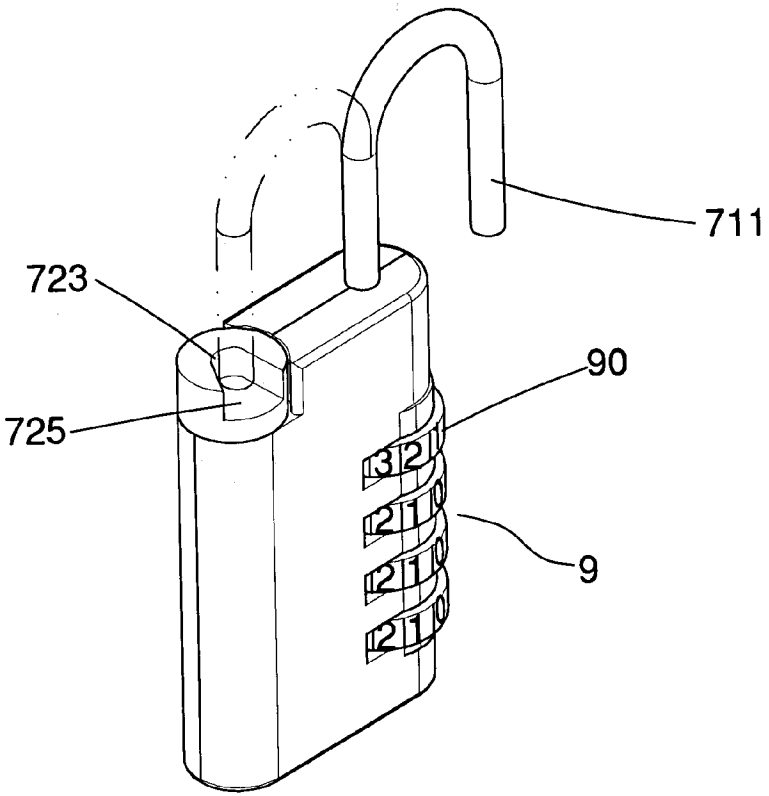
FIG. 22 is a perspective view of the fourth embodiment showing a slot of the engaging portion of the block being rotated to a position for releasing the shorter arm of the shackle.
Figure 21:
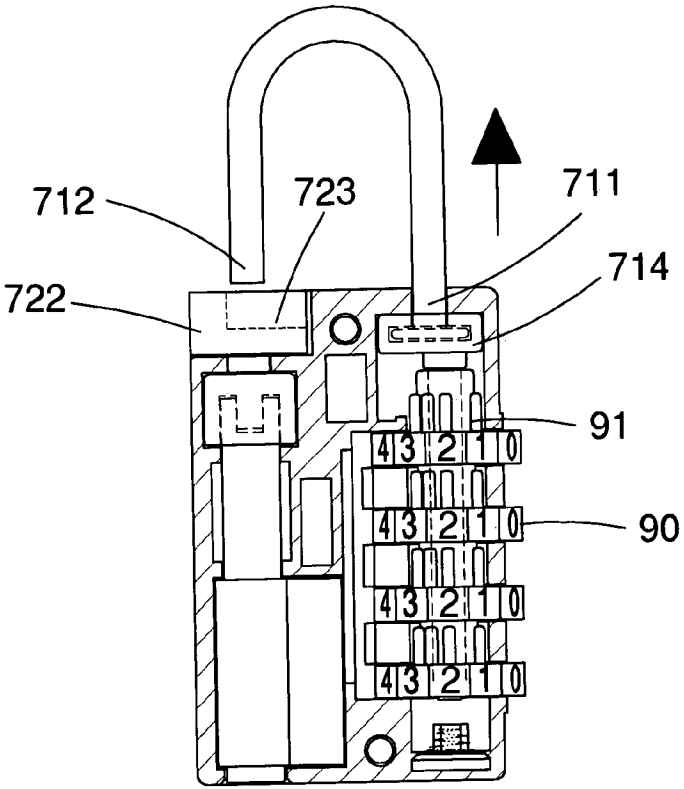
FIG. 21 is a cross sectional view of the fourth embodiment showing the longer arm of the shackle being released from the combination locking means.
Figure 24:
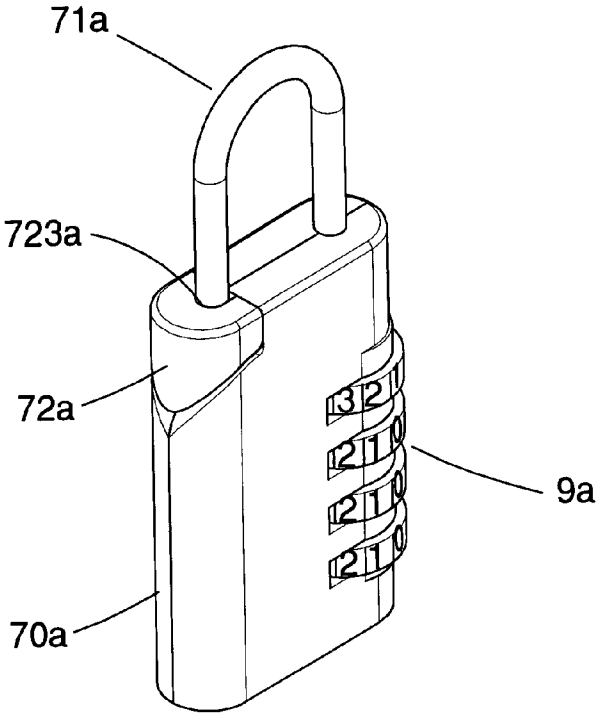
FIG. 24 is a perspective view of the fifth embodiment.
Figure 23:
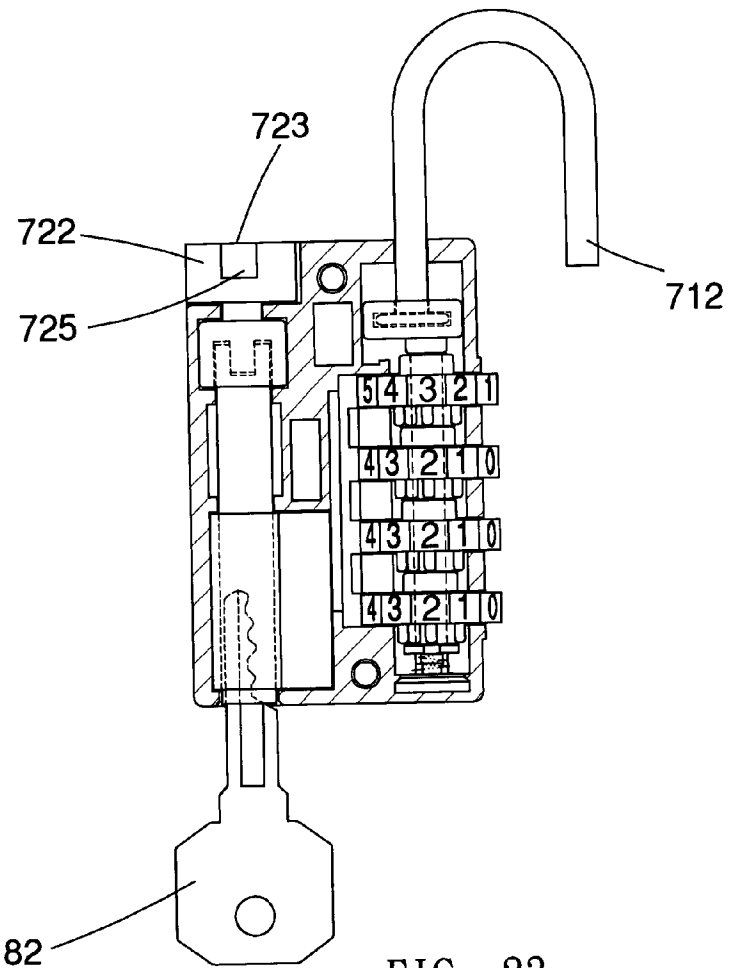
FIG. 23 is a cross sectional view of the fourth embodiment showing the slot of the engaging portion of the block being rotated by the key and the shorter arm of the shackle be removed from the slot.
Figure 26:
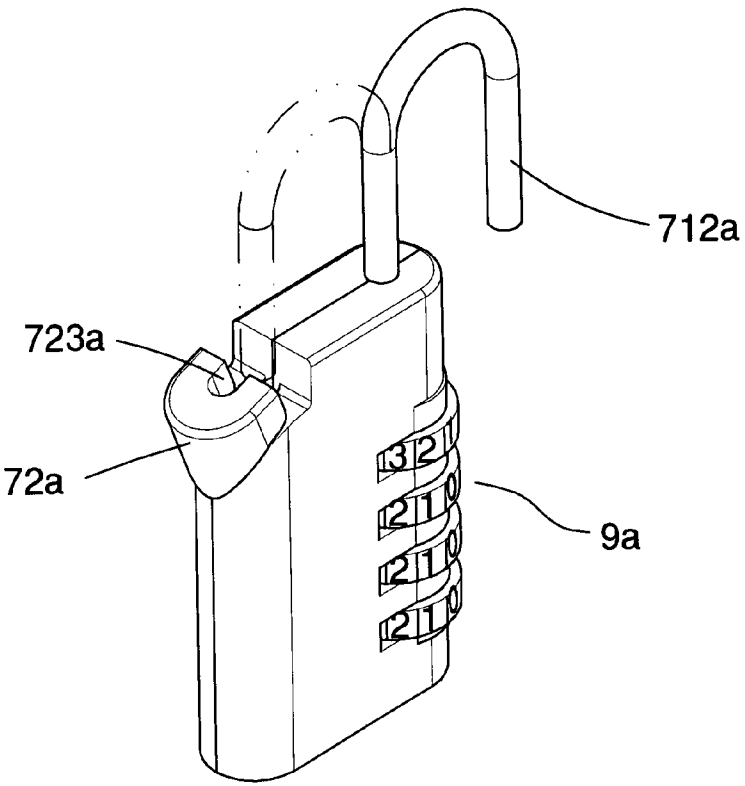
FIG. 26 is a perspective view of the fifth embodiment showing the block being rotated to allow the shorter arm of the shackle being released from the slot.

The padlock of the second embodiment of the present invention is illustrated in FIG. 8, FIG. 10 and FIG. 11. The second embodiment contains a lock body 1*a*, a block 3*a*, a shackle 2*a* and a combination locking means 5*a* the same as the first embodiment. The block 3*a* further contains a hood 301*a* mounted thereto. The hood 301*a* moves synchronously with the block 3*a*. The hood 301*a* contains plural windows 302*a* therethrough, corresponding to the number wheels 50*a* of the combination locking means 5*a*. Thereby, when the padlock is locked, the hood 301*a* covers the number wheels 50*a* for preventing them from being reached. If the padlock is unlocked, the number wheels 50*a* can be reached through the windows 302*a*. The second embodiment further contains a locking mechanism 6 formed therein. The locking mechanism 6 contains: a locking block 60 having a hook 601 thereon engagable with the flange 23*a* of the longer arm 20*a* of the shackle 2*a*, a rectangular bump 602 thereon and a spring 61 for biasing the locking block 60 to engage with the flange 23*a* of the longer arm 20*a* of the shackle 2*a*. With reference to FIG. 8 and FIG. 11, the key operated locking means 4*a* of the second embodiment contains: a body 40*a* having a rotor 41*a* received therein and a hemi-cylinder 44*a* extended from the rotor 41*a*. The rotor 41*a* has a keyhole 43*a* at a bottom end thereof for being engaged with a key 42*a*. The hemi-cylinder 44*a* is engaged with the rectangular bump 602 for releasing the hook 601 of the locking block 60 from the flange 23*a* of the longer arm 20*a* of the shackle 2*a*. Referring to FIG. 9, when the flat surface of the hemi-cylinder 44*a* is overlaid with the flat surface of the rectangular bump 602, the hook 601 is engaged with the flange 23*a* of the longer arm 20*a*. Referring to FIG. 11 and FIG. 12, when the hemi-cylinder 44*a* is rotated by the key 42*a* to press against the rectangular bump 602 to move the locking block 60 away from the flange 23*a*, the hook 601 is disengaged from the flange 23*a* of the longer arm 20*a*. The longer arm 20*a* then be biased upward and the shorter arm 21*a* is removed from the receptacle 32*a*.

With reference to FIG. 13 to FIG. 17, the padlock of the third embodiment of the present invention contains a lock body 1*b*, a shackle 2*b*, a block 3*b*, a locking mechanism 6*b* and a key operated locking means 4*b* the same as the second embodiment. The stem 51*b* of the combination locking means 5*b* has a recess 53 at top thereof. The recess 53 has a concave 531 at a wall thereof. The block 3*b* has a gap 33 communicated with the receptacle 32*b* of the block 3*b*. The gap 33 has a width larger than the diameter of the shorter arm 21*b* for receiving the end of the shorter arm 21*b*. The mounting portion 30*b* of the block 3*b* has a protrusion 34 thereon for being engaged with the concave 531. The mounting portion 30*b* is received in the recess 53. After dialing the combination locking means to an unlocking number, the gap 33 can be rotated to a position that the shorter arm 21*b* can be removed therefrom.

The first embodiment, the second embodiment and the third embodiment has the same structures having the key operated locking means 4, 4*a*, 4*b* for locking or unlocking the longer arm 20, 20*a*, 20*b* of the shackle 2, 2*a*, 2*b* and the combination locking means 5, 5*a*, 5*b* for controlling movements of the block 3, 3*a*, 3*b* in order the block 3, 3*a*, 3*b* to be engaged with or disengaged from the shorter arm 21, 21*a*, 21*b* of the shackle 2, 2*a*, 2*b*. However the opposite arrangements as follows also work.

With reference to FIG. 18 to FIG. 23, the padlock of the fourth embodiment of the present invention mainly contains: a lock body 70, a block 72, a shackle 71, a combination locking means 9 and a key operated locking means 8. The lock body 70 has a corner defining a space 703, a first channel 701 and a second channel 702 therein. The block 72 is engaged with the second channel 702. The block 72 has a receptacle 723 therein. The shackle 71 has a longer arm 711 slidably received in the first channel 701 and a shorter arm 712 engagable with the receptacle 723 of the block 72. The combination locking means 9 formed in the lock body 70 for locking or unlocking the longer arm 711 of the shackle 71. The key operated locking means 8 is formed in the lock body 70 for controlling movements of the block 72 in order the block 72 to be engaged with or disengaged from the shorter arm 712 of the shackle 71. The block 72 further has a gap 725 communicated with the receptacle 723 of the block 72. The gap 725 has a width larger than the diameter of the shorter arm 712 for receiving the end of the shorter arm 712 and can be rotated to be blocked completely by a wall 7031 of the lock body 70.

The block 72 contains: an engaging portion 722 installed in the space 703 of the lock body 70 and having the gap 725 communicated with the receptacle 723 therein, a neck portion 720 and a mounting portion 721. The neck portion 720 is received in the second channel 702, and connects the engaging portion 722 and the mounting portion 721. Additionally, the diameter of the neck portion 720 is smaller than the diameters of the engaging portion 722 and the mounting portion 721. The key operated locking means 8 contains: a body 80 having a rotor 81 received therein and a driving rod 813 extended from the rotor 81. The rotor 81 has a keyhole 811 at a bottom end thereof for being engaged with a key 82. The gap 725 of the engaging portion 722 is engagable with the shorter arm 712 of the shackle 71. The mounting portion 721 has two sockets 724. The driving rod 813 has two plates 812 at an end thereof. The two plates 812 are engaged with the two sockets 724 for rotating the block 72. The key 82 rotates the gap 725 to a position and the shorter arm 712 can be removed from the gap 725.

The longer arm 711 of the shackle 71 has a stop 714 at an end thereof and the first channel 701 has an opening with a diameter smaller than the stop 714 for preventing the longer arm 711 from fully sliding off the first channel 701. The stop 714 includes a U-shaped receiver 7141 and a bottom plate 7142 which is extended from an end of the longer arm 711, and rotatably confined within the U-shaped receiver 7141. The combination locking means 9 contains a stem 91 connected with the U-shaped receiver 7141 of the stop 714 of the longer arm 711 of the shackle 71 and plural number wheels 90 rotatably mounted around the stem 91 for locking or unlocking the longer arm 711 of the shackle 71. When the plural number wheels 90 of the combination locking means 9 are dialed to an unlocking number, the stem 91 is unlocked and movable accordingly. Correspondingly, the stop 714 is moved by the stem 91 and the longer arm 711 is moved upwardly thereby, so as to remove the shorter arm 712 from the receptacle 723. The gap 725 of the receptacle 723 is a radial gap having a smallest width at an inner periphery, wherein the smallest width of the radial gap is larger than the diameter of the shorter arm 712 of the shackle 71.

With reference to FIG. 24 to FIG. 27, the padlock of the fifth embodiment of the present invention mainly contains: a lock body 70*a*, a block 72*a*, a spring 724*a*, a shackle 71*a*, a combination locking means 9*a* and a key operated locking means 8*a*. The lock body 70*a* has a channel 701*a* therein. The block 72*a* is pivotally received in the lock body 70*a*. The block 72*a* has a slot 723*a* thereon. The spring 724*a* is engaged with the block 72*a* for restoring the block 72*a*. The shackle 71*a* has a longer arm 711*a* slidably received in the channel 701*a* and a shorter arm 712*a* engagable with the slot 723*a* of the block 72*a*. The combination locking means 9*a* is formed in the lock body 70*a* for locking or unlocking the longer arm 711*a* of the shackle 71*a*. The key operated locking means 8*a* is formed in the lock body 70*a* for controlling rotation of the block 72*a* in order the block 72*a* to be engaged with or disengaged from the shorter arm 712*a* of the shackle 71*a*. The block 72*a* has a protrusion 721*a* thereon. The key operated locking means 8*a* contains a body having a rotor 81*a* received therein and a hemi-cylinder 812*a* extended from the rotor 81*a*. The rotor 81*a* has a keyhole 83*a* at a bottom end thereof for being engaged with a key 82*a*. The hemi-cylinder 812*a* is engaged with the protrusion 721*a* of the block 72*a*.

Figure 25:
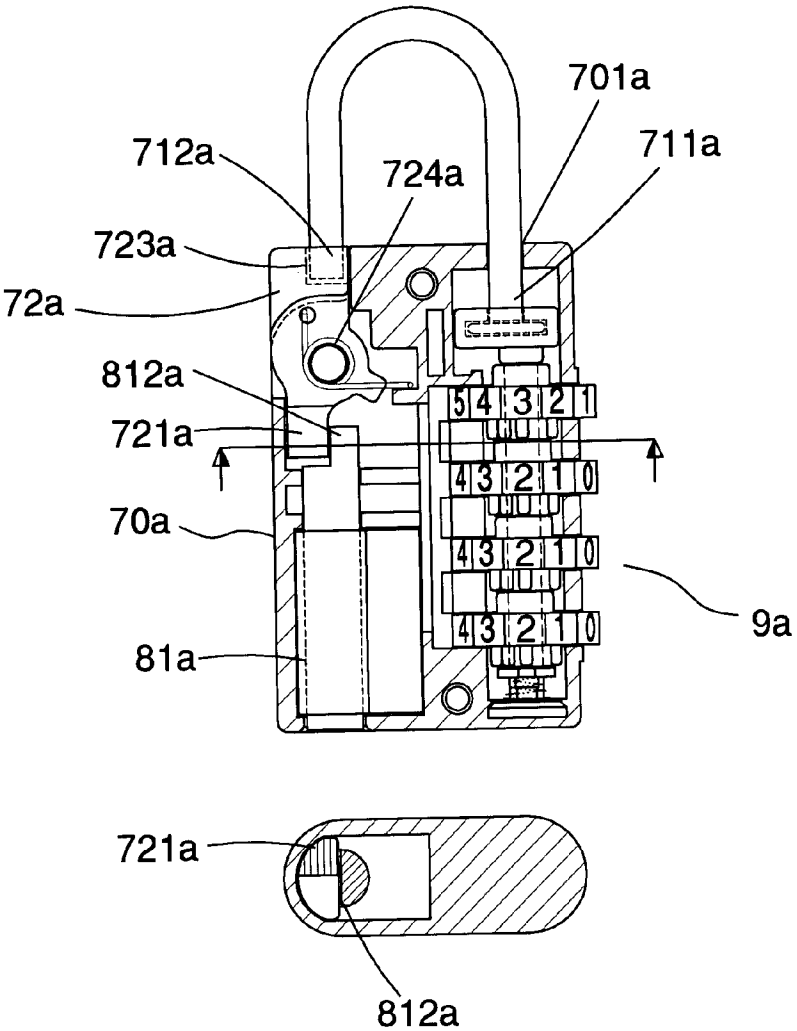
FIG. 25 is a cross sectional view of the fifth embodiment showing the shackle being locked and the protrusion of the block being engaged with the hemi-cylinder for preventing the block from rotation.
Figure 28:
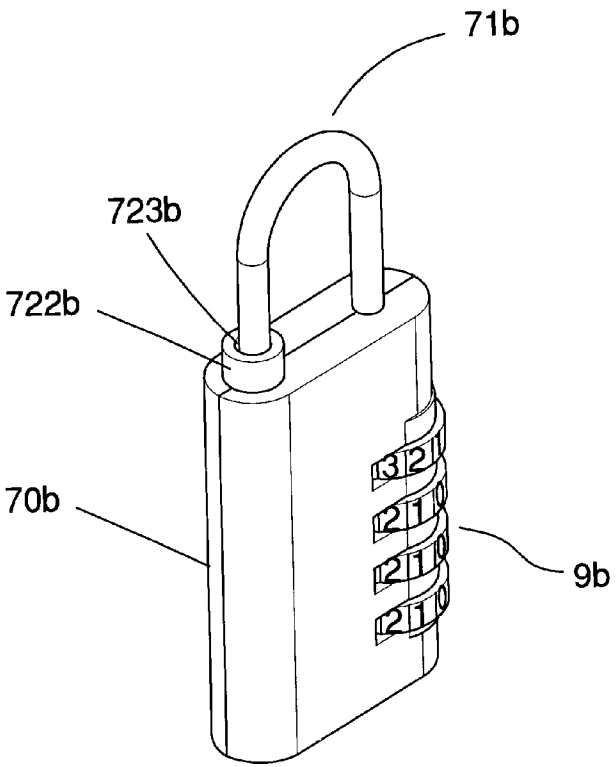
FIG. 28 is a perspective view of the sixth embodiment.
Figure 27:
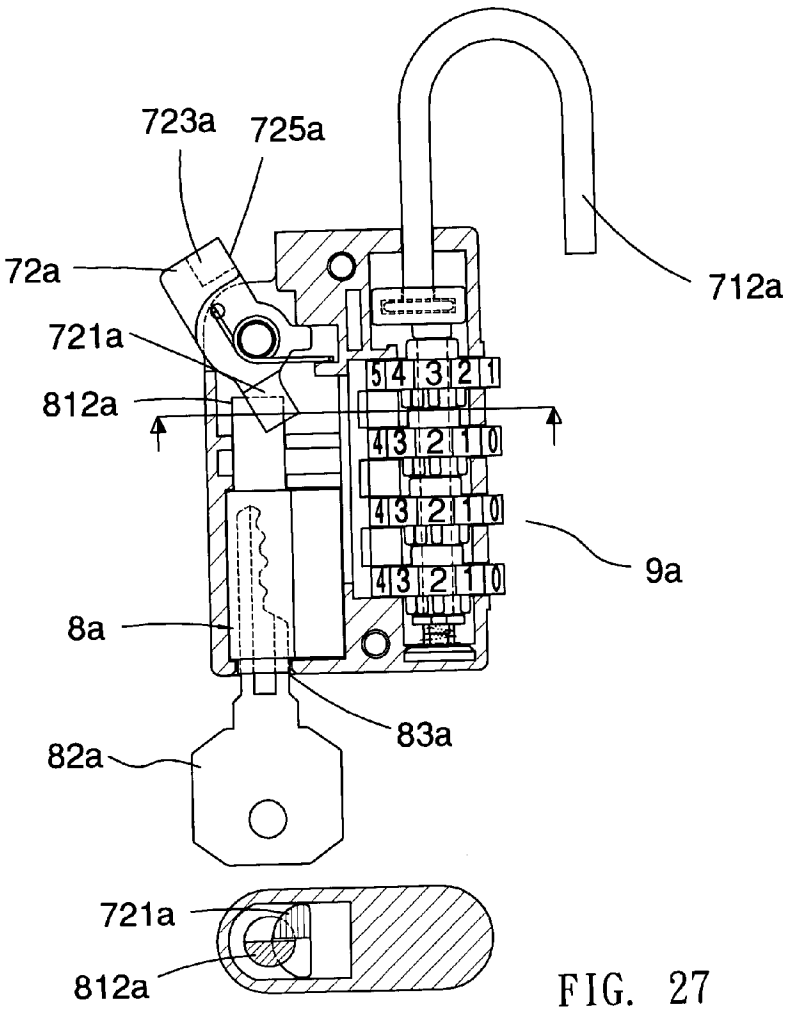
FIG. 27 is a cross sectional view of the fifth embodiment showing the key rotates the hemi-cylinder to a position for allowing the block being rotated to allow the shorter arm of the shackle being released from the slot.

Referring to FIG. 25, the protrusion 721*a* is engaged with the hemi-cylinder 812*a*. Thereby the block 72*a* is prevented from rotation. Referring to FIG. 27, the key 82*a* rotates the rotor 81*a* and the hemi-cylinder 812*a* to a position; thereby the block 72*a* can rotate to let the shorter arm 712*a* removed from the slot 723*a*. The combination locking means 9*a* of the fifth embodiment is the same as the combination locking means 9 of the fourth embodiment.

Figure 30:
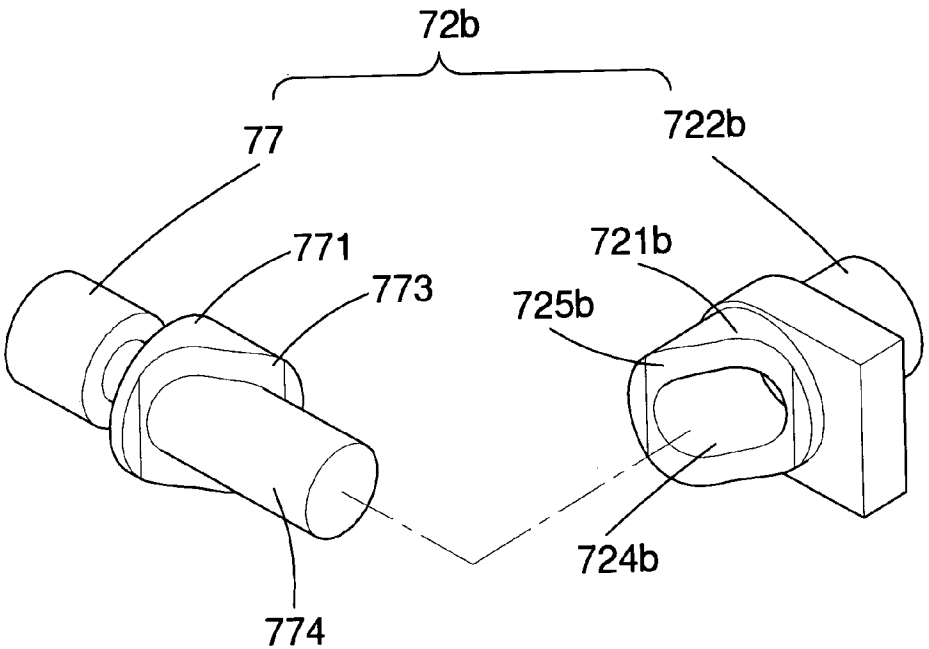
FIG. 30 is an exploded view of the engaging portion and the mounting portion of the block of the sixth embodiment.

With reference to FIG. 28 to FIG. 31, the padlock of the sixth embodiment of the present invention contains a lock body 70*b*, a shackle 71*b*, a key operated locking means 8*b*, and a combination locking means 9*b* the same as the fourth embodiment. Referring to FIG. 30, a block 72*b* contains an engaging portion 722*b* and a mounting portion 77. The engaging portion 722*b* has a first column 721*b* at one end. The first column 721*b* has a hole 724*b* therein and a first inclined surface 725*b*. The mounting portion 77 has a second column 771 and a cylinder 774 extended from the second column 771. The cylinder 774 is rotatable and slidably received in the hole 724*b* of the first column 721*b*. The second column 771 has a second inclined surface 773 engagable with the first inclined surface 725*b* of the first column 721*b*.

Figure 29:
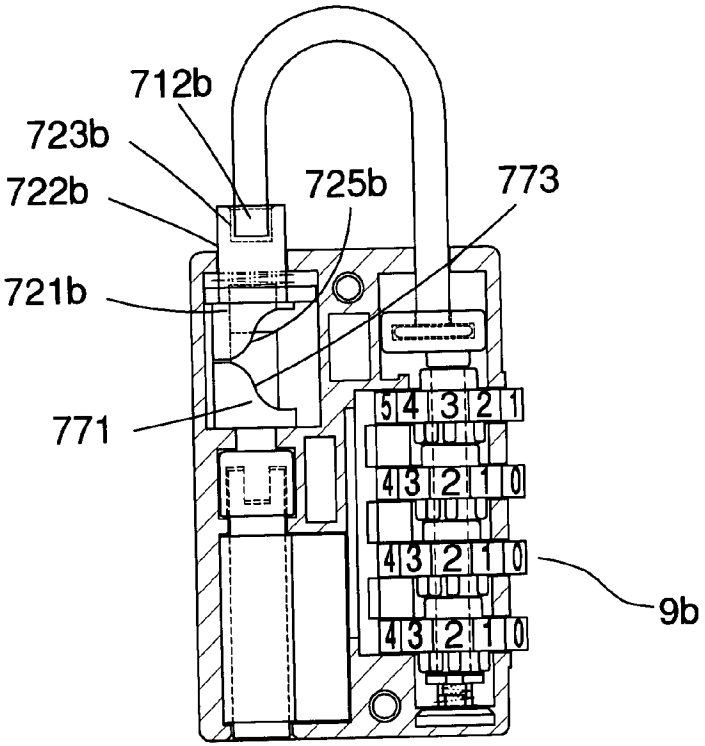
FIG. 29 is a cross sectional view of the sixth embodiment showing the shackle being locked.
Figure 31:
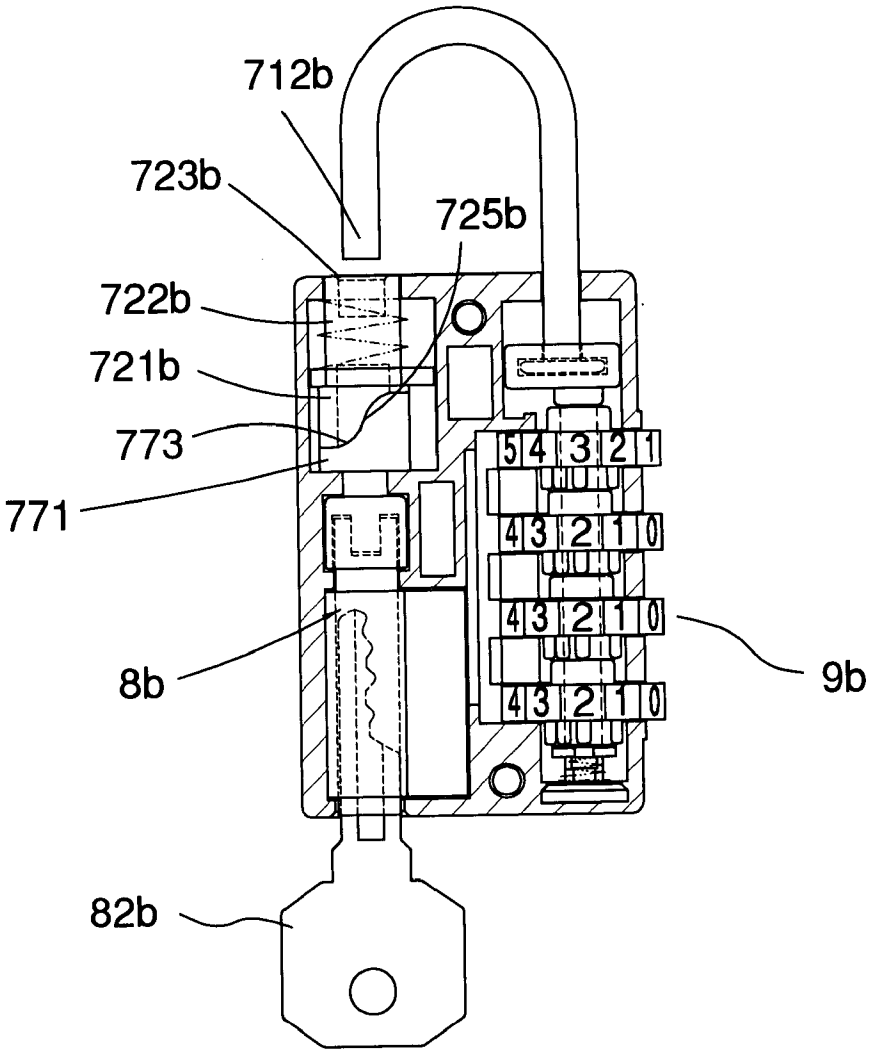
FIG. 31 is a cross sectional view of the sixth embodiment showing the block being moved downwardly for releasing the shorter arm of the shackle.

Referring to FIG. 29, when the padlock is locked, the first inclined surface 725*b* of the first column 721*b* contacts the second inclined surface 773 of the second column 771 only with their top portions. The total height of the engaging portion 722*b* and the mounting portion 77 is the biggest. Referring to FIG. 31 when the key 82*b* unlock the padlock, the first inclined surface 725*b* of the first column 721*b* fully contacts the second inclined surface 773 of the second column 771. The total height of the engaging portion 722*b* and the mounting portion 77 is the smallest. Thereby the engaging portion 722*b* of the block 72*b* is retreated into the lock body 70*b* and the shorter arm 712*b* is released from the receptacle 723*b*.

Numerous characteristics and advantages of the invention have been set forth in the foregoing description, together with details of the structure and function of the invention, and the novel features thereof are pointed out in appended claims. The disclosure, however, is illustrated only, and changes may be made in detail, especially, in matters of shape, size and arrangement of parts, materials and the combination thereof within the principle of the invention, to the full extend indicated by the broad general meaning of the terms in which the appended claims are expressed.

We claim:

1. A padlock comprising:

a housing having a notch in a corner thereof, a wall facing said notch, a first hole and a second hole; said first and second holes both being in communication with an inside of the housing and facing in a same direction;

a shackle having a root section partly received in said housing via said first hole of said housing, and a free section extending from said root section and being disposed outside said housing; said free section being rotatable about said root section to a locked position and an unlocked position; and a confining block including a block portion received in said notch of said housing and a stem portion received inside said housing via said second hole and extending from a bottom of said block portion; said block portion having a receptacle which is outside said housing with a first opening defined in top of said block portion and a second opening defined in a side of said block portion and in communication with said first opening; wherein when said free section is placed in said locked position, said first opening of said receptacle receives said free section of said shackle and said free section has a distal end set at a level higher than a first level defined by a bottom surface of said receptacle and lower than a second level defined by a top surface of said housing; and said block portion together with said stem portion being rotatable with respect to said housing between a first position where said second opening faces said wall of said housing, and a second position where said second opening is turned away from said wall of said housing.

2. The padlock of claim 1 further comprising a numeral wheel set disposed in said housing, wherein said numeral wheel set includes:

a shaft being parallel with said stem portion of said confining block and lying diagonally opposite to said block portion of said confining block;

a plurality of inner sleeves in parallel with one another and placed around said shaft; and a plurality of digit-wheels each mounted around a respective one of said inner sleeves.

3. The padlock of claim 1, wherein said wall of said housing is substantially parallel with said root section of said shackle and is concaved toward said root section so as to form an outwardly facing concave surface corresponding to a profile of an outer surface of said block portion of said confining block.

4. The padlock of claim 1 further comprising a locking mechanism disposed in said housing, wherein said locking mechanism is configured for control rotation of said confining block.

* * * * *